US005678385A

United States Patent [19]

Focke et al.

[11] Patent Number: 5,678,385

[45] Date of Patent: Oct. 21, 1997

[54] PACKAGING MACHINE FOR THE PRODUCTION OF CIGARETTE PACKS

[75] Inventors: Heinz Focke; Harald Gosebruch, both of Verden, Germany

[73] Assignee: Focke & Co. (GmbH & Co.), Verden, Germany

[21] Appl. No.: 588,293

[22] Filed: Jan. 18, 1996

Related U.S. Application Data

[63] Continuation of Ser. No. 312,065, Sep. 26, 1994, abandoned.

[30] Foreign Application Priority Data

Sep. 27, 1993 [DE] Germany ..... 43 32 810.5

[51] Int. Cl.[6] ..... B65B 19/04

[52] U.S. Cl. ..... 53/148; 53/202; 53/234; 53/151

[58] Field of Search ..... 53/150, 151, 148, 53/176, 504, 202, 207, 234, 564; 198/418.2, 418.3

[56] References Cited

U.S. PATENT DOCUMENTS

| | | | |
|---|---|---|---|
| 3,391,520 | 7/1968 | Albrecht | 53/202 |
| 3,589,097 | 6/1971 | Gianese | 53/168 |
| 3,956,865 | 5/1976 | Schmermund | 53/148 |
| 4,020,608 | 5/1977 | Seragnoli | 53/234 |
| 4,084,393 | 4/1978 | Focke . | |
| 4,096,682 | 6/1978 | Sheahan | 53/151 |
| 4,308,708 | 1/1982 | Focke . | |
| 4,341,298 | 7/1982 | Dingli | 198/418.3 |
| 4,550,550 | 11/1985 | Scott | 53/504 |
| 4,607,477 | 8/1986 | Hinchcliffe et al. . | |
| 4,735,032 | 4/1988 | Focke . | |
| 4,819,407 | 4/1989 | Focke et al. . | |
| 4,852,335 | 8/1989 | Focke et al. | 53/234 |
| 4,866,912 | 9/1989 | Deutsch | 53/176 |
| 4,909,020 | 3/1990 | Focke | 53/202 |
| 4,918,908 | 4/1990 | Focke et al. . | |
| 4,938,005 | 7/1990 | Focke . | |
| 4,943,271 | 7/1990 | Focke et al. . | |
| 5,038,546 | 8/1991 | Oberdorf | 53/202 |
| 5,050,855 | 9/1991 | Focke et al. . | |

FOREIGN PATENT DOCUMENTS

| | | |
|---|---|---|
| 357943 | 8/1980 | Austria . |
| 1238834 | 9/1972 | Germany . |
| 2831323 | 1/1980 | Germany . |
| 3639994 | 5/1988 | Germany . |
| 3802644 | 8/1989 | Germany . |
| 3820863 | 12/1989 | Germany . |
| 3931309 | 12/1990 | Germany . |
| 3941603 | 6/1991 | Germany . |
| 3925272 | 10/1991 | Germany . |

*Primary Examiner*—John Sipos
*Assistant Examiner*—Gene L. Kim
*Attorney, Agent, or Firm*—Sughrue, Mion, Zinn, Macpeak & Seas, PLLC

[57] ABSTRACT

To increase the output of packaging machines for cigarettes, a common cigarette stock, in particular a cigarette magazine, is assigned a plurality of independently working packaging units (11, 12, 13, 14). These are fed with cigarette groups, for packaging, by the cigarette magazine (10) via a common conveyor. The packaging units (11 to 14) consist of a folding unit (24), of a material unit and of a drive unit. Depending on the desired output, a pluraity of packaging units (11 to 14) can be combined as part of the packaging machine. The packaging units (11 to 14) are subdivided again into units to be handled independently, in particular into a folding unit (24), a material unit and a drive unit. These are exchangeable and, for the operation of the packaging machine, are connected functionally to one another.

17 Claims, 6 Drawing Sheets

PACKAGING MACHINE FOR THE PRODUCTION OF CIGARETTE PACKS

This is a Continuation of application Ser. No. 08/312,065 now abandoned filed Sep. 26, 1994.

BACKGROUND OF THE INVENTION

The invention relates to a packaging machine for the production of cigarette packs, especially hinge-lid packs, with a central cigarette stock, in particular a cigarette magazine, with folding members for the folding of blanks to form the packs and with assemblies for the stocking and handling of packaging material, in particular material assemblies.

Packaging machines for cigarettes are designed according to the identical concept that a (limited) cigarette stock, in particular cigarette magazine, folding members, especially folding turrets, and material assemblies for the stocking and preparation of packaging material, together with drive members, constitute a unit, in particular a packaging machine of conventional type. In a production or packaging plant, in each case a plurality of such packaging machines is arranged in a spatially distributed manner. Feeding with cigarettes and packaging material takes place via conveying devices leading to the packaging machines.

A machine concept of this kind is no longer in keeping with the constant requirements for higher outputs, above all because the individual mechanical members reach the output limit.

SUMMARY OF THE INVENTION

The object on which the invention is based is to propose a new concept for packaging machines, by means of which a further increase in output, without a variation of individual members of the packaging machine, can be achieved.

To achieve this object, the packaging machine according to the invention is characterized in that a common cigarette stock or a common cigarette magazine is assigned a plurality of packaging units, each with a complete set of folding members and material assemblies. As a result of the invention, the principle of modular construction is introduced in the conceptional design of packaging machines for cigarettes. The cigarette magazine, as a standard device of a packaging machine, is laid out and designed so that it can supply a plurality of packaging units, that is to say independent modules. According to the invention, the packaging units are themselves self-contained and delimited structures for the production or part production of a cigarette pack. The packaging machine can be equipped with a number of such packaging units which corresponds to the desired output. At least two, preferably four packaging units, together with a cigarette magazine, form a packaging machine. This also includes the drive members, necessary in each case, as part of a packaging unit.

According to a further feature of the invention, each packaging unit is divided into further independent part units, in particular into a folding unit on the one hand and into a material unit on the other hand. The folding unit is equipped with the necessary folding members, especially with one or more folding turrets and conveying members. The material unit is equipped with the material assemblies which exist for the production of blanks from continuous material webs and for feeding these to the folding members or out of magazines having finished blanks.

The individual units are positioned relative to one another in a special way, so that free access to each unit for service personnel is possible.

Further features of the invention relate to the design of individual units, including the cigarette magazine.

Exemplary embodiments of the packaging machine according to the invention are explained in more detail below by means of the drawings. In these:

DESCRIPTION OF PREFERRED EMBODIMENTS

Figure 1:
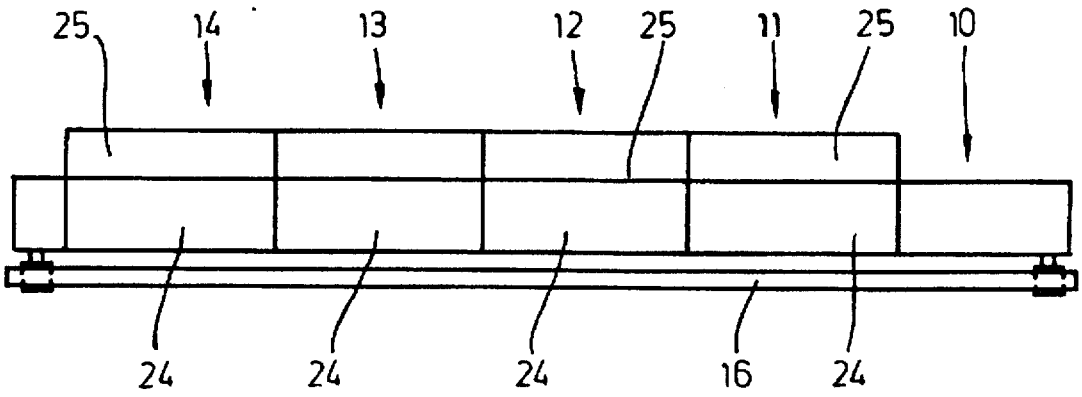
FIG. 1 shows a packaging machine in a diagrammatic plan view as a block diagram.

The concept of a packaging machine or packaging plant is shown greatly simplified in one embodiment in FIG. 1. The packaging machine consists of a plurality of units or modules according to the productivity of individual regions or of individual members. A first unit forms a cigarette stock, in particular a cigarette magazine 10, assigned to the packaging machine. This is designed so that it serves for feeding a plurality of packaging units 11, 12, 13, 14. In the exemplary embodiment of FIG. 1, four such packaging units 11 to 14 are positioned in succession in a row and next to one another. The packaging units 11 to 14 are fed with cigarette groups ready for packaging which each correspond to the content of a cigarette pack 15 to be produced. The cigarette groups are transferred, in the region of the cigarette magazine 10, onto a common conveyor, in particular onto a pocket chain 16. This consists of lined-up pockets 17, each for receiving a cigarette group. The pocket chain 16 runs with an upper strand from the cigarette magazine along all the successive packaging units 11 to 14. Cigarette groups are transferred from the pocket chain 16 onto a packaging unit 11 to 14 in the region of a respective pushing-in station 18.

Each packaging unit 11 to 14 independently produces cigarette packs 15 which are transported away via discharge conveyors 19 assigned to each packaging unit 11 to 14 and which, for example, pass into a collecting conveyor.

Figure 3:
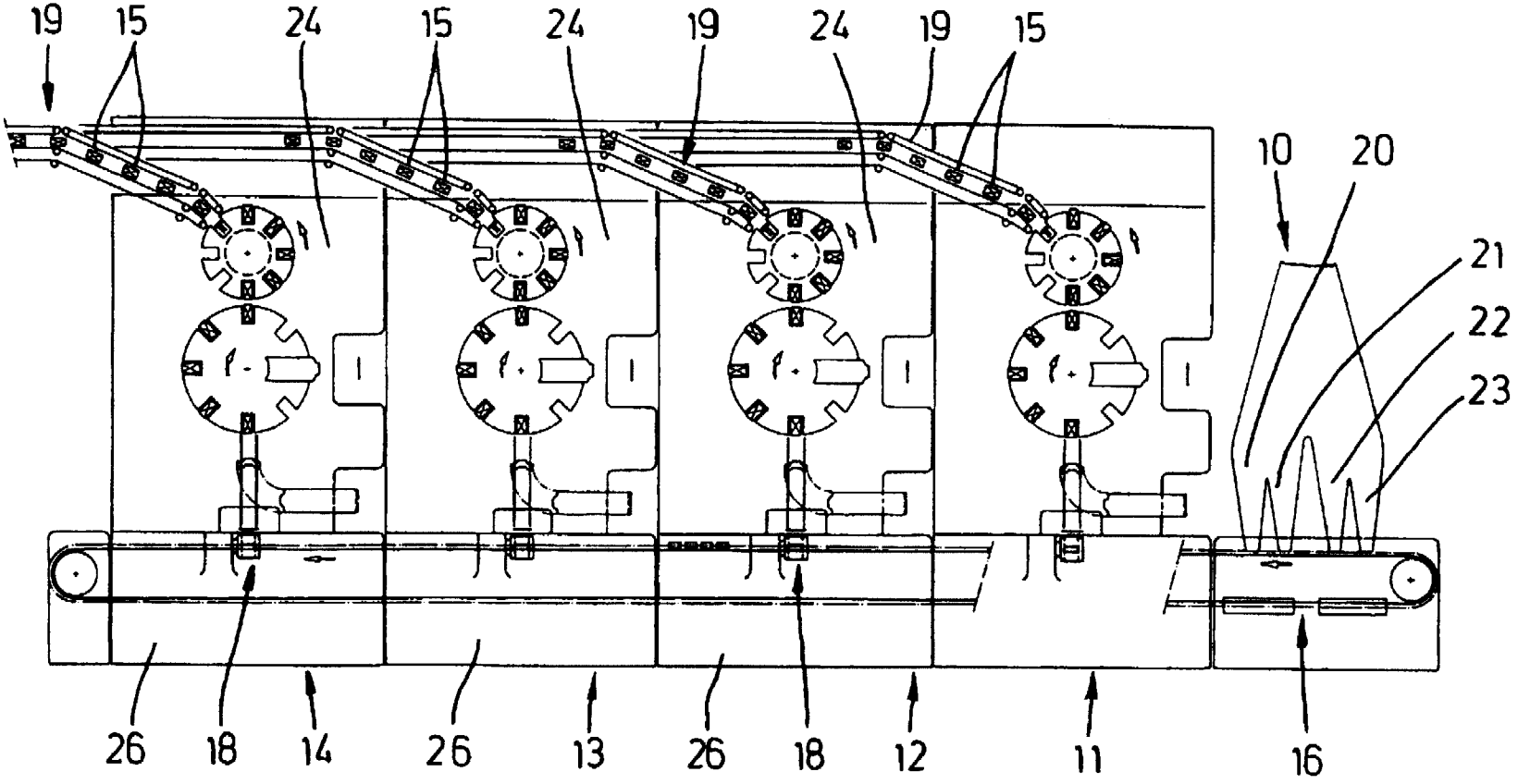
FIG. 3 shows a packaging machine according to the concept of FIG. 1 in a side view.

The cigarette magazine is designed in a special way in order to manage the higher output. In the exemplary embodiment of FIG. 3, four shaft groups 20, 21, 22 and 23 are provided for collecting the cigarettes and for forming the cigarette groups pushed out at the bottom. The shaft groups 20 to 23 are designed in the customary way. Slides not shown in detail are assigned to each shaft group 20 to 23 for pushing out a respective cigarette group. These, after leaving the shaft group 20 to 23, are received directly by a correspondingly positioned pocket 17 of the pocket chain 16. The output of the cigarette magazine 10 is coordinated with that of the packaging units 11 to 14. Each packaging unit 11 to 14 is assigned one shaft group 20 to 23.

Figure 4:
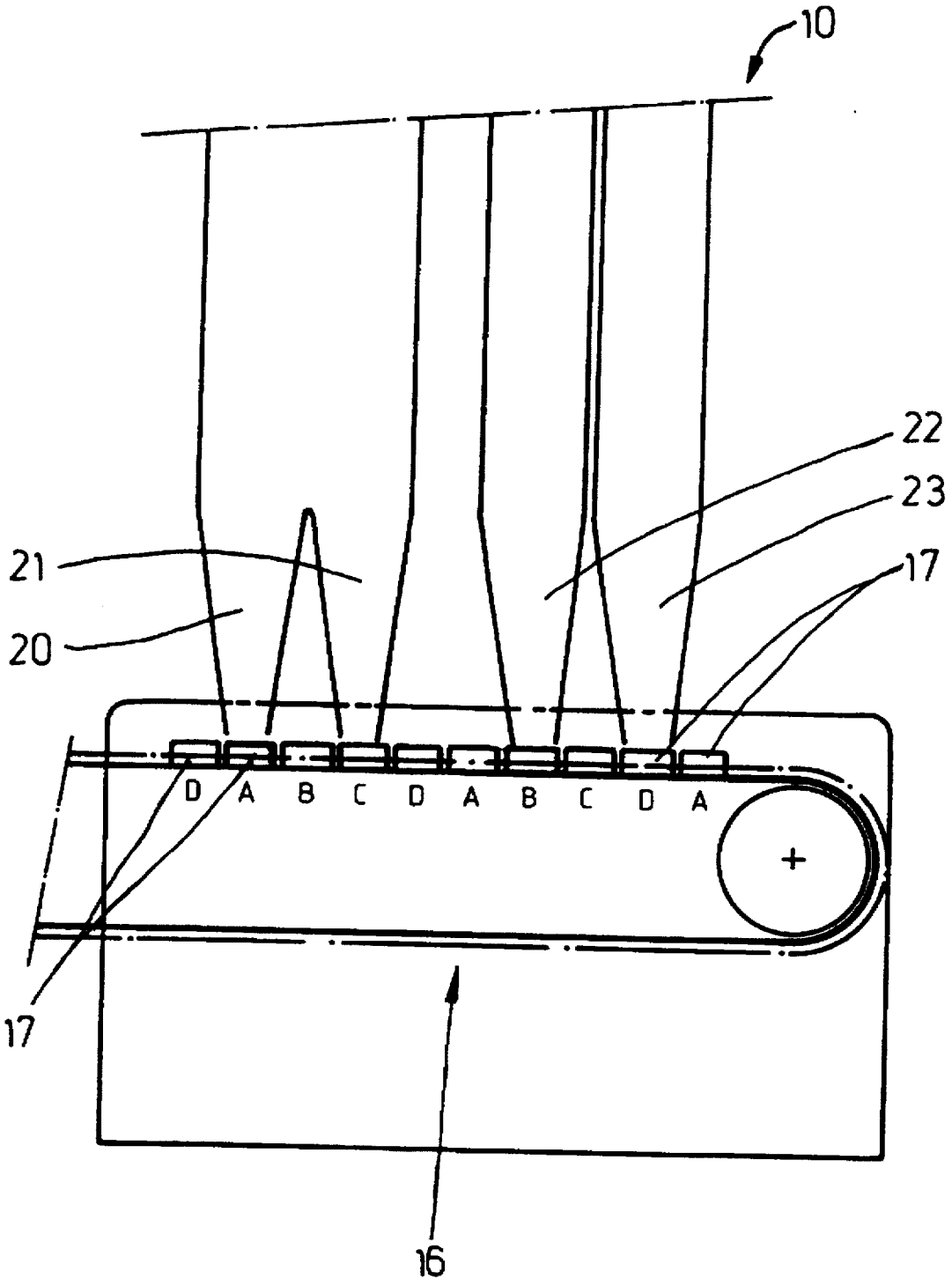
FIG. 4 shows details of a cigarette magazine in a greatly simplified side view.

FIG. 4 shows diagrammatically a modified version of a cigarette magazine 10. Four shaft groups 20 to 23 are likewise present. The two shaft groups 20, 21 are combined to form a unit. Two cigarette groups at a time can be extracted from this via the shaft groups 20, 21. In contrast, the shaft groups 22 and 23 are made independent. They can be fed with cigarettes individually. Furthermore, cigarette groups can be extracted individually. If the packaging machine is equipped with four packaging units 11 to 14, all four shaft groups 20 to 23 must supply cigarette groups. If there is a smaller number of packaging units 11, etc., the shaft groups 22 and/or 23 can be put out of operation. The cigarette magazine designed in the above way allows the simultaneous processing of up to three different cigarette types.

The shaft groups 20 to 23 are arranged at such distances from one another that the pocket chain 16, moved one stroke further each time, always positions a free pocket 17 in front of each shaft group 20 to 23. Accordingly, while the pocket chain 16 is at a stand-still, cigarette groups are pushed out of each shaft group 20 to 23 and thus four pockets 17 of the pocket chain 16 are filled. The minimum distance between the lower regions of the shaft groups 20 to 23 corresponds to double the division of the pocket chain 16. In the present case, the latter has a pocket distance of, for example, 70 mm. The minimum distance between the shaft groups 20 to 23 corresponds to double the chain or pocket division. In the embodiment illustrated in FIG. 4, the two shaft groups 20, 21 and the two shaft groups 22, 23 are each separated by a distance corresponding to twice the pocket division, while the shaft groups 20, 21 are separated from the shaft groups 22, 23 by a distance corresponding to three times the pocket division.

The packaging units 11 to 14 are independent modules for the production of complete cigarette packs 15—in the present exemplary embodiment, without an outer wrapping made from plastic film. Each packaging unit 11, etc. therefore contains a complete set of folding members, of assemblies for handling the packaging material (material assemblies) and of drive members. In the exemplary embodiments illustrated, each packaging unit 11, etc. is divided into a plurality of, in particular three part units to be handled independently, in particular into a folding unit 24, a material unit 25 and a drive unit 26. These accordingly together form a packaging unit 11. The part units, in particular the folding unit 24, material unit 25 and drive unit 26, are positioned relative to one another in such a way that cooperation during the production of the cigarette pack 15 is guaranteed. In the exemplary embodiment shown, the folding unit 24 confronts the feed conveyor or the pocket chain 16. The material unit 25 is positioned on the rear side of the folding unit 24, and the common drive unit 26 is arranged, here, as a base underneath the two abovementioned units.

The members of the folding unit 24 on the one hand and of the material unit 25 on the other hand are, in each case, mounted on the free side, that is to say on the front side on the one hand and on the rear side on the other hand. Free access to the individual members is thereby guaranteed.

Figure 5:
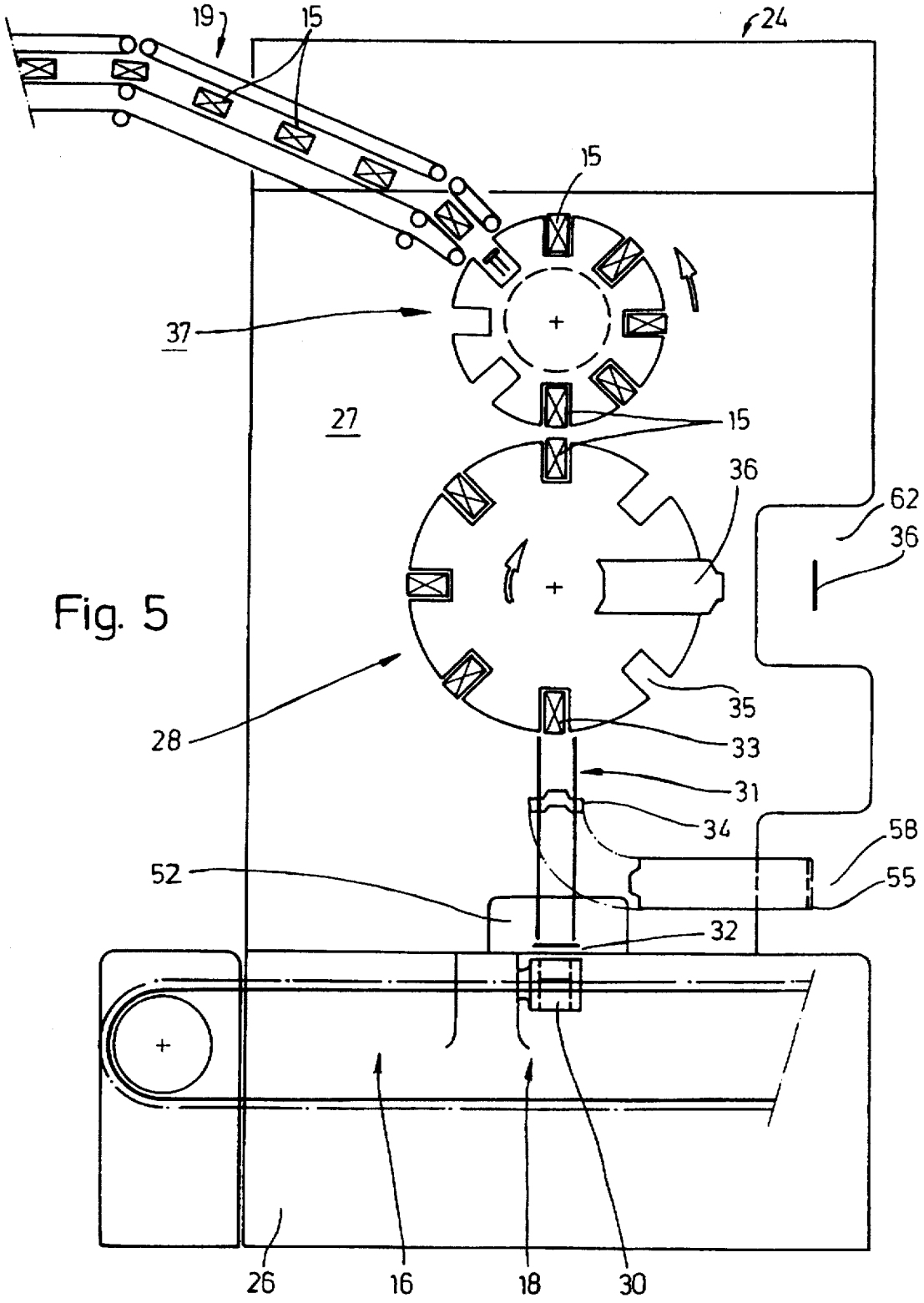
FIG. 5 shows an exemplary embodiment of a folding unit in a front view.

The folding unit 24 consists of a box-like structure with an arrangement of folding and conveying members on the free side on a vertical supporting wall 27. In the present exemplary embodiment (see FIGS. 5 and 6), a folding turret 28 rotating about a horizontal axis is mounted approximately centrally on the supporting wall 27. Here, the folding turret 28 is designed, for example, in the same way as the folding turret described and illustrated in U.S. Pat. No. 4,084,393.

The cigarette groups are fed to the folding turret 28 from below. Here, the pocket chain 16 runs in a plane below the folding unit 24, in particular level with the drive unit 26. The cigarette groups are pushed by a transversely directed slide 29 out of the pocket 17 and into a turning wheel 30. This is arranged directly next to the pocket chain 16 in the pushing-in station 18 of each packaging unit 11, etc. The turning wheel 30 is driven intermittently, each time with a 90° rotation. As a result, the cigarette groups are moved into a vertical position. They are pushed out of the turning wheel 30 upwards. For performing this function, the turning wheel 30 is provided with two intersecting continuous radial slots for the passage of the cigarette groups.

The cigarette groups then pass into the region of the folding unit 24. They enter an upwardly directed conveyor track 31. A first blank, in particular an inner blank 32 made from paper or tinfoil, is kept ready in this conveyor track 31 on the (lower) entry side. This is first laid around the cigarette group in a U-shaped manner and is folded completely during further transport. For this purpose, the conveyor track 31 can be designed in the same way as described and illustrated in U.S. Pat. No. 4,308,708.

Wrapping the cigarette group in the inner blank 32 results in a cigarette block 33. A further blank, a collar blank 34, is fed to the latter during further upwardly directed transport in the conveyor track 31. Together with this collar blank 34, the cigarette block 33 is then pushed in the radial direction or in the upward direction into a pocket 35 of the folding turret 28.

During transport by the folding turret 28, the cigarette block 33 is wrapped in a blank, in particular in the actual pack blank 36. In the present case, this consists of thin cardboard and serves for the production of a hinge-lid pack. As regards the folding of the pack blank 36, the procedure can take place according to U.S. Pat. No. 4,084,393.

The cigarette pack 15 (virtually) ready-folded in respect of the pack blank 36 is pushed upwards out of the pocket 35 of the folding turret 28 in an upper position relative to the conveyor track 31 and is pushed into a further-conveyor, in particular into a transfer turret. In the region of the latter, the folding of the pack blank 36 is completed with regard to the adhesive bonding of side tabs of the side walls. The finished cigarette pack 15 is then ejected out of the transfer turret 37 into the discharge conveyor 19. The cigarette packs 15 are transferred from the transfer turret 37 onto the discharge conveyor 19 in a direction of movement pointing obliquely upwards. The latter consists of a plurality of conveyor bands which are deflected in order to deflect the packs out of the oblique position into a horizontal position while they are being conveyed away.

The described folding and conveying members of the folding unit 24 are mounted in the supporting wall 27 by means of horizontal mountings or by means of horizontal drive shafts 38 and 39 respectively. The drive shafts 38, 39 and other drive members are transmission-connected to the drive unit 26 within the folding unit 24 designed as a housing.

Figures 6, 7:
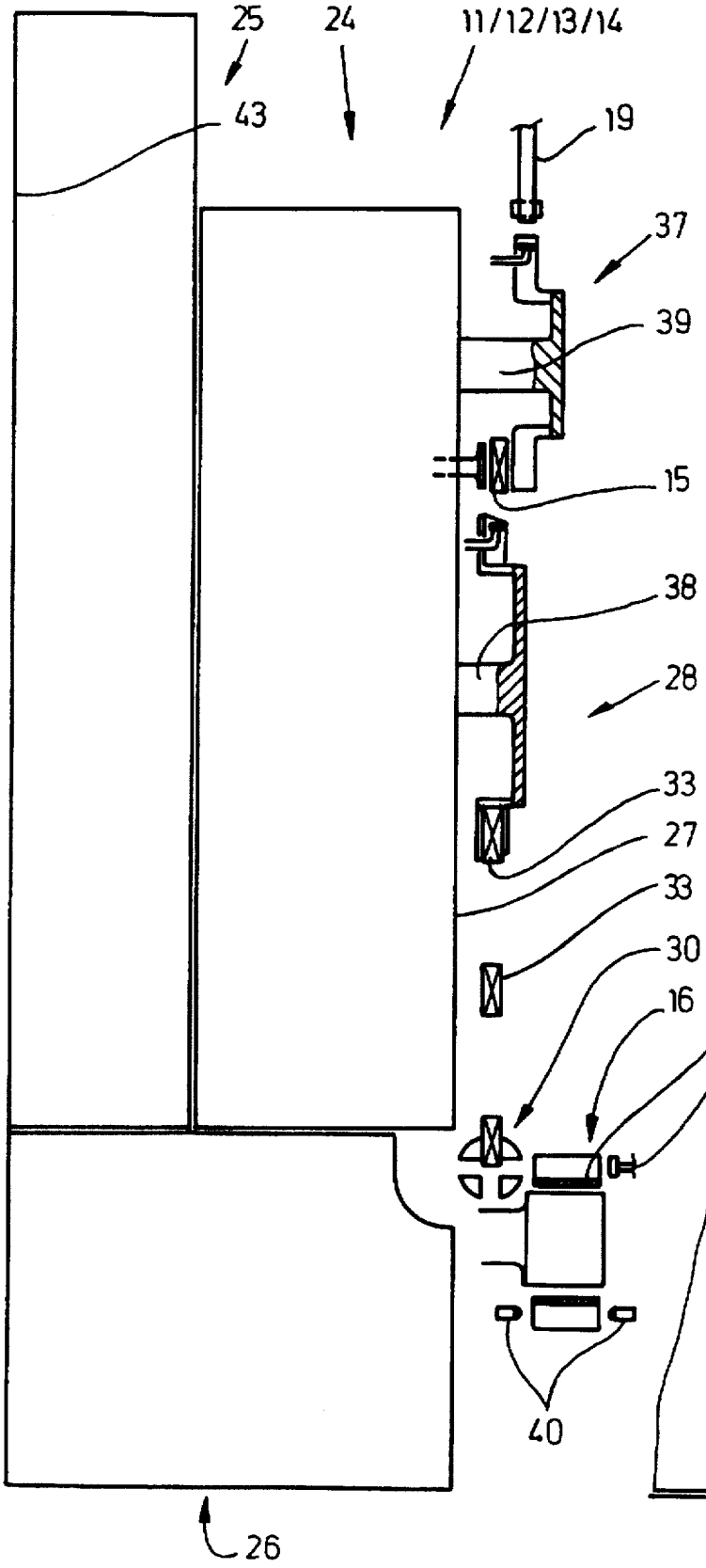
FIG. 6 shows a packaging unit in a transverse view with details of the folding unit.
FIG. 7 shows a detail of a conveyor for cigarette groups, in particular a pocket chain, in vertical section.
Figure 8:
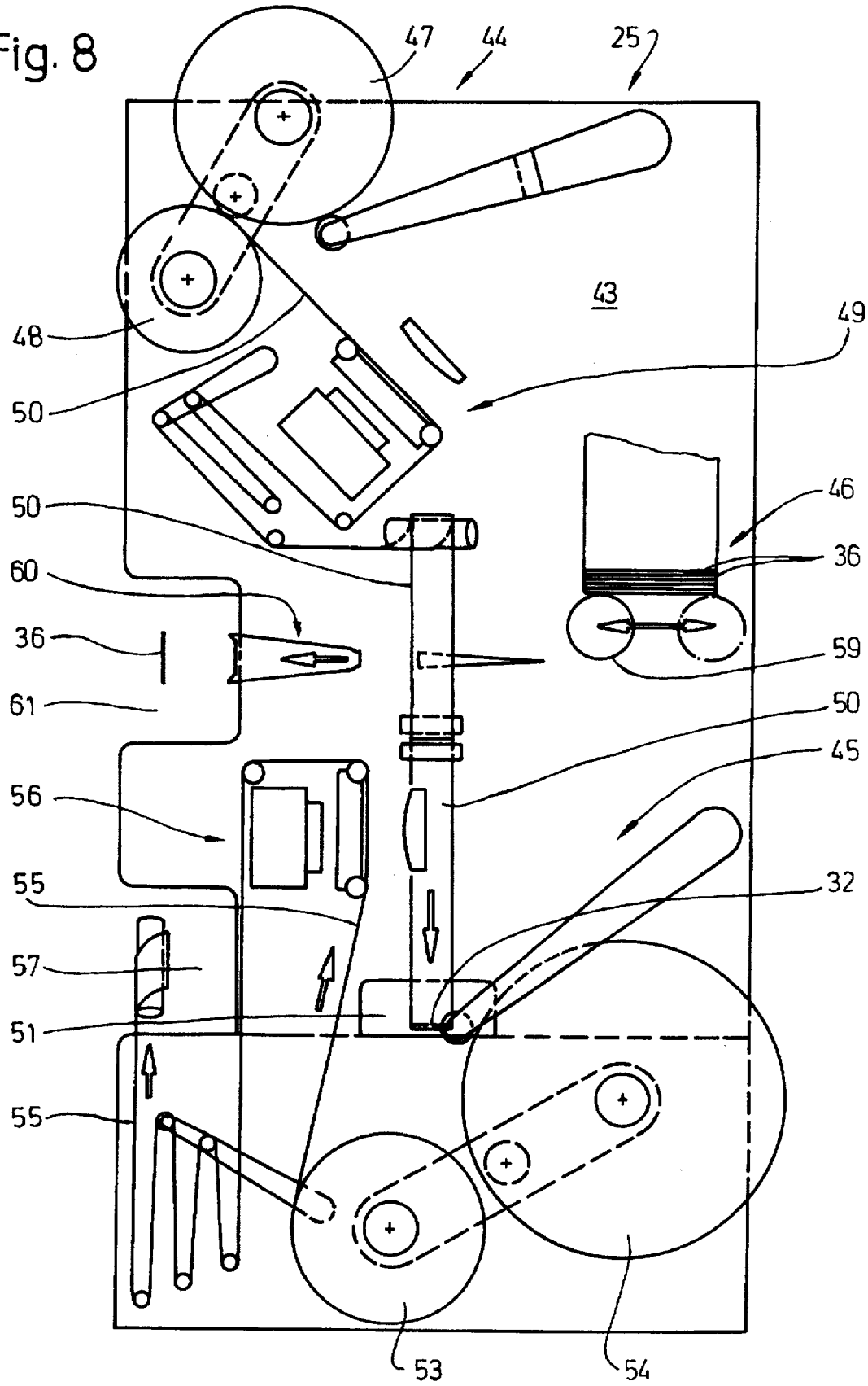
FIG. 8 shows a material unit in a representation similar to that of FIG. 5.

FIG. 7 shows an interesting detail. The pockets 17 of the pocket chain 16 are checked for the presence of cigarette groups in the region of a lower return strand by optoelectrical sensors 40. If cigarette groups are located in individual pockets 17 as a result of incorrect switching, they are ejected at a suitable point, in particular by a slide 41. The cigarettes pass into a collecting container 42 (FIG. 7). If one folding unit 24 fails, the others can in this way continue to work without restriction.

The material unit 25 is constructed in a similar way to the folding unit 24. Material assemblies for handling packaging material are arranged on a supporting wall 43 of a supporting device designed as a housing. In the exemplary embodiment illustrated, these are a paper assembly 44, a collar assembly 45 and a blank magazine 46. The supporting wall 43 is arranged on the side facing away from the supporting wall 27 of the folding unit 24.

The paper assembly 44 serves for producing and supplying the inner blanks 32 for the inner wrapping. These can consist of paper or tinfoil. The packaging material for this purpose is delivered as a rolled-up web, in particular as a reel. The paper assembly 44 is designed in such a way that, in each case, a stock reel 47 and an active run-off reel 48 are present. Furthermore, the paper assembly 44 includes a splicing device 49 for connecting the running-off material web 50 to the free end of the stock reel 47. The paper assembly can thus far be designed as in DE-P 43 25 944.8. The material web 50 (paper or tinfoil) is conveyed downwards from the paper assembly 44 arranged in the upper region of the supporting wall 43, in particular as far as the lower edge of the material unit 25. In this region, the inner blanks 32 are severed from the material web 50 by a severing device not shown in detail. The inner blanks 32 are then fed to the front side of the folding unit 24. For this purpose, the material unit 25 is provided with a recess 51 at the lower edge of the material unit 25. This matches a corresponding recess 52 in the folding unit 24. Accordingly, by means of the two recesses 51, 52, the inner blanks 32 are conveyed from the rear side of the packaging unit 11, in particular from the material unit 25, to the front side into the region of the members of the folding unit 24.

The collar blanks 34 are prepared by a collar assembly 45 designed in a similar way. This, like the paper assembly 44, is provided with a receptacle for a run-off reel 53 and a stock reel 54. A material web 55 consisting of thin cardboard is drawn off from the run-off reel 53 and is conveyed through a splicing device 56. The material web 55 passes via deflecting rollers into the region of a recess 57 of the material unit 25, the said recess 57 being arranged at a lateral edge. A correspondingly arranged recess 58 at the edge of the folding unit 24 (FIG. 5) matches this recess 57. The material web 55, being appropriately deflected, is conveyed through the recesses 57, 58 to the front side of the folding unit 24. Arranged here is a severing member for severing the individual collar blanks 34 from the material web 55.

The prefabricated pack blanks 36 are located in a relatively large number in the blank magazine 46 likewise arranged on the supporting wall 43 of the material unit 25. The pack blanks 36 are extracted in succession at the bottom by a suitable member, for example by a rolling-off device 59, and are conveyed via a horizontally extending conveyor track 60 to the opposite edge of the material unit 25. During transport, the pack blanks 36 are rotated, so that they finally extend in a vertical plane. For this purpose, the conveyor track 60 is provided with turning rollers which, during transport, bring about the rotational movement of the pack blank 36.

Located at the free edge of the material unit 25 is a further recess 61 for the transport of the pack blank 36 to the front side, in particular to the folding unit 24. This is likewise provided at the same point with a lateral recess 62. The pack blank 36, being deflected once more, is fed to the folding turret 28 in the region of the folding unit 24. The recesses 61, 62 are exactly level with this folding turret 28.

In the packaging machine, the number of packaging units 11 to 14 can be selected, without further variation, according to the desired output. Furthermore, however, the individual units, in particular the folding unit 24, material unit 25 and drive unit 26, can also be exchanged within the packaging units 11 to 14, especially for repair purposes or in the event of a format change, that is to say the production of cigarette packs of another size.

Figure 2:
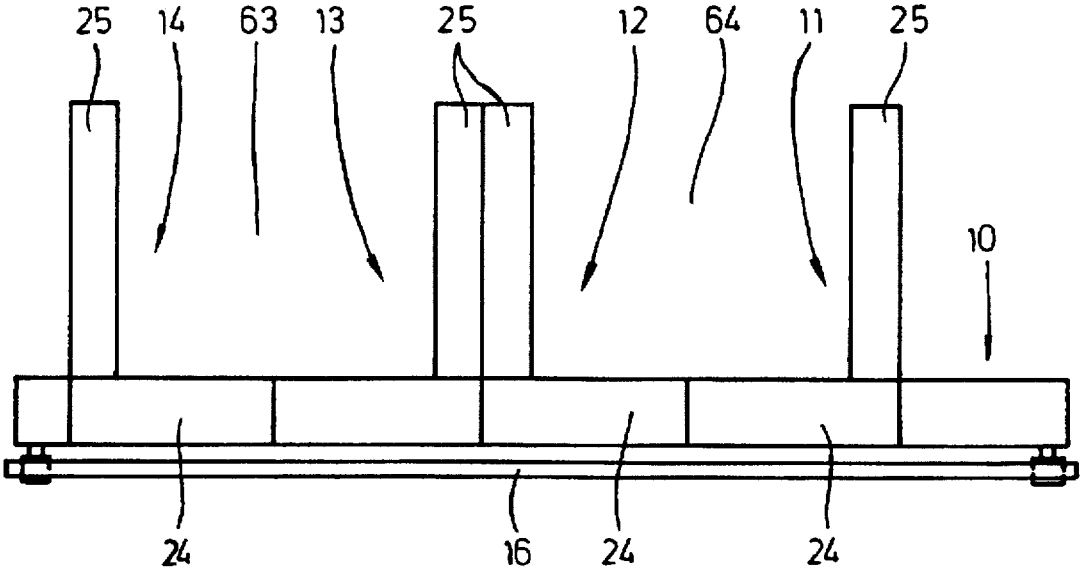
FIG. 2 shows a representation, similar to that of FIG. 1, of another embodiment of the packaging machine.

FIG. 2 shows an alternative for the relative position of the individual packaging units 11, etc. or of their sub-units. In this version, as in FIG. 1, the folding units 24 are arranged in succession and directly next to one another in the conveying direction of the cigarette groups. In this formation, the associated material units 25 are arranged transversely to the folding units 24. This results in an angular plan shape. Two middle material units 25 rest with their rear sides against one another. Interspaces 63 and 64 allowing easy access for service personnel are thereby obtained. In this configuration too, the members of the folding units 24 and of the material units 25 are free for any manual interventions. In this solution, the drive units 26 can be positioned underneath the folding units 24 and/or the material units 25. The abovementioned units are connected respectively to one another by means of suitable couplings, especially for drive transmission. Moreover, the packaging units 11, etc. are provided with their own drive and can be operated independently of one another, specifically synchronously with the movement of the pocket chain 16.

What is claimed is:

1. A packaging machine for producing cigarette packs (15), each consisting of a formed cigarette group enwrapped in packaging material, said packaging machine comprising:

a) a cigarette magazine (10) for storing and discharging formed cigarette groups; and b) a conveyor (16), located downstream of the cigarette magazine (10), for conveying the formed cigarette groups in a downstream conveying direction along a conveying path; and c) a plurality of independent packaging units (11 to 14) located along the conveying path of the conveyor, d) wherein each packaging unit (11 to 14) contains a material unit (25) having a plurality of material assemblies for stocking and handling packaging material, and a folding unit (24) having a plurality of folding members for folding blanks around the cigarette groups (15), e) wherein, for stocking folding members with the blanks, each folding unit (24) has a first upright supporting wall (27) having a side on which the folding members are mounted such that the folding members are all accessible from the same side of the first supporting wall (27), f) wherein, for stocking the material assemblies with packaging material, each material unit has a second upright supporting wall (43) having a side on which the material assemblies are mounted such that the material assemblies are all accessible from the same side of the second supporting wall (43), and g) wherein, within each packaging unit (11 to 14), the folding unit (24) and the material unit (25) are located adjacent to one another;

h) said packaging machine further comprising means for feeding the packaging material from the material unit (25) to the folding unit (24); and i) wherein the folding unit (24) and the material unit (25) are back to back relative to each other, and wherein the packaging material stocked in the material unit (25) is conveyable from the material unit (25) to a free side of the folding unit (24) via recesses (51, 57, 61), in the material unit (25), and matching recesses in the folding unit (24).

2. The packaging machine as claimed in claim 1, wherein the folding members and the material assemblies are freely accessible within each packaging unit (11 to 14), wherein the side of the first supporting wall (27) which receives the folding members faces away from the material unit, and wherein the side of the second supporting wall (43) which receives the material assemblies faces away from the folding unit (25).

3. The packaging machine as claimed in claim 2, wherein the folding unit (24) and the material unit (25) are arranged back-to-back within each packaging unit (11 to 14), with said first and second supporting walls (27, 43) being parallel to each other.

4. The packaging machine as claimed in claim 1, wherein the folding unit (24) and the material unit (25) are disposed at a right angle to one another within each packaging unit, with said first and second supporting walls (27, 43) being disposed at a right angle to one another.

5. The packaging machine as claimed in claim 1, wherein each packaging unit (11 to 14) has a common independent drive unit (26) for the folding unit (24) and the material unit (25).

6. The packaging machine as claimed in claim 5, wherein the drive unit (26) is formed as a base and underneath at least the folding unit (24) or the material unit (25).

7. The packaging machine as claimed in claim 1, wherein the folding members and the material assemblies are mounted on each upright folding unit (24) or material unit (25) on top of one another and next to one another with horizontal drive shafts (38, 39).

8. The packaging machine as claimed in claim 1, wherein there are mounted on the first supporting wall (27) of the folding unit (24): a conveyor track extending in an upward direction from below for transporting cigarette groups, each wrapped in an inner blank (32); at approximately mid-height and centrally, a folding turret (28) rotating in a vertical plane for processing pack blanks (36); and, above the folding turret (28), a transfer turret (37) and a discharge conveyor (19) for upwardly transporting away the enwrapped cigarette packs (15).

9. The packaging machine as claimed in claim 1, wherein the folding members (24) of the folding unit (24) face towards the conveyor (16), wherein the first supporting wall (27) is arranged upright and parallel to the conveyor (16), and wherein the material unit (25), with the second supporting wall (43), is located on a folding unit side which faces away from the conveyor (16).

10. The packaging machine as claimed in claim 9, wherein the folding unit (24) and the material unit (25) are disposed at right angles to one another, with said first and second supporting walls (27, 43) disposed at right angles to one another, and wherein the material units (25) of adjacent ones of said packaging units (12, 13) are arranged back-to-back in pairs, with their material assemblies facing away from one another.

11. The packaging machine as claimed in claim 1, wherein the conveyor (16) is a horizontal conveyor with pockets (17), each for receiving one cigarette group from the cigarette magazine (10), said packaging machine further comprising, means for pushing the cigarette groups out of the pockets (17) transversely to the conveying direction of the conveyor (16) feeding the cigarette groups to the packaging units (11 to 14).

12. A packaging machine for producing cigarette packs (15), each consisting of a formed cigarette group enwrapped in packaging material, said packaging machine comprising:

a) a single cigarette magazine (10) for storing and discharging formed cigarette groups; and b) a conveyor (16), located downstream of the cigarette magazine (10), for conveying the formed cigarette groups in a downstream conveying direction along a conveying path;

c) a plurality of individual packaging units (11 to 14) located along the conveying path of the conveyor for respectively receiving cigarette groups from one side of the conveyor, d) wherein, in a lower region of each packaging unit (11 to 14), the cigarette groups assigned to a respective packaging unit are introduced into the individual flow of motion of the packaging unit in a conveying direction which is directed from a bottom to a top of the unit; and e) means for removing formal cigarette packs (15) at the opposite side of the conveyor (16) and at the top side of the respective packaging unit (11 to 14);

f) wherein each packaging unit (11 to 14) comprises: at least one material unit (25) for storing and handling the packaging material, and for carrying material handling devices, material reels, separating members and transporting members for webs of the material; and at least one folding unit (24) for folding blanks and for forming the cigarette packs (15), and for carrying folding devices, folding turrets and folding members;

g) wherein the material unit (25) comprises a first upright supporting wall (43) on which the material handling material handling devices, reels, separating members and transporting members of the material unit (25) are positioned;

h) wherein the folding unit (24) is provided with a second upright supporting wall (27) on which the folding devices, folding turrets and folding members of the folding unit (24) are positioned;

i) wherein inside each packaging unit (11 to 14), the material unit (25), with its first supporting wall (43), and the folding unit (24) with its supporting wall (27) lie next to one another so that at least edges of the first and second supporting walls (43, 27) are located adjacent to one another and butt against one another; and j) means for passing said packaging material from said material unit to a free side of said folding unit.

13. The packaging machine as claimed in claim 12, wherein the handling devices and members of each material unit (25) are all arranged on the same side of the first supporting wall (43), and wherein the folding devices, folding turrets and members of each folding-unit (24) are all arranged on the same side of the second supporting wall (27).

14. The packaging machine as claimed in claim 13, wherein said units and the members of the material unit (25), and the folding devices, folding turrets and folding members of the folding unit (24), in the case of the back-to-back arrangement of the first and second supporting walls (43, 27), are arranged on sides of the supporting walls facing away from one another.

15. The packaging machine as claimed in claim 12, wherein the folding devices, folding turrets and folding members of the folding unit (24) are face towards the conveyor (16) on the second supporting wall (27) extending parallel to the conveyor (16), whereas the first supporting wall (43), lying at the angle relative to the second supporting wall (27), is on the side of the supporting wall (27) facing away from the conveyor (16).

16. The packaging machine as claimed in claim 12, wherein a flow of the packaging material from the material unit (25) to the folding unit (24) takes place in a region of recesses (51, 57, 61 and 52, 58, 62) in lower and/or lateral edges of the first and second supporting walls.

17. The packaging machine as claimed in claim 12, wherein said magazine has a plurality of shaft groups (20 to 23) for storing and discharging the formed cigarette groups, and wherein certain ones of said shaft groups are associated with certain ones of the packaging units such that the cigarette groups discharged from the certain shaft groups are always fed to the same packaging unit or packaging units.

* * * * *